US006176905B1

(12) United States Patent
Priggemeyer et al.

(10) Patent No.: US 6,176,905 B1
(45) Date of Patent: Jan. 23, 2001

(54) PROCESS AND REACTION SOLUTION FOR PRODUCING A PATINA

(75) Inventors: Sonja Priggemeyer; Stefan Priggemeyer, both of Wallenhorst; Stefan Hoveling, Osnabrück, all of (DE)

(73) Assignee: KM Europa Metal AG, Osnabruck (DE)

( * ) Notice: Under 35 U.S.C. 154(b), the term of this patent shall be extended for 0 days.

(21) Appl. No.: 09/263,315

(22) Filed: Mar. 5, 1999

(30) Foreign Application Priority Data

Mar. 7, 1998 (DE) ..... 198 09 904

(51) Int. Cl.[7] ..... C09D 5/00; B05D 3/10; B05D 5/00

(52) U.S. Cl. ..... 106/1.18; 106/31.06; 106/31.95; 427/256; 427/123; 427/282; 427/307; 427/328; 427/349; 427/383.1; 427/405

(58) Field of Search ..... 106/1.18, 31.06, 106/31.95; 427/123, 256, 282, 307, 328, 349, 383.1, 405

(56) References Cited

U.S. PATENT DOCUMENTS 4,325,177 * 4/1982 DePoorter ..... 427/275
5,160,381 * 11/1992 Gervais ..... 148/269
5,282,890 * 2/1994 Protzer et al. ..... 148/276
5,344,671 * 9/1994 Wottrich ..... 427/192
5,376,190 * 12/1994 Hoveling ..... 148/269
5,714,052 * 2/1998 Hoveling et al. ..... 205/137

FOREIGN PATENT DOCUMENTS

62/192586 * 8/1986 (JP) .
08/035072 * 2/1996 (JP) .

OTHER PUBLICATIONS

Derwent abstract of JP03/247675, Nov. 1990.*
Derwent abstract of JP56/013483, Feb. 1981.*
Derwent abstract of JP53/122638, Oct. 1978.*

* cited by examiner

*Primary Examiner*—Helene Klemanski
(74) *Attorney, Agent, or Firm*—Kenyon & Kenyon

(57) ABSTRACT

By applying a reaction solution containing an aqueous solution of copper salts and salts of inorganic acids, to a pre-oxidized or partially already patinated copper surface, it is possible to produce a patina layer on copper objects, either directly at the construction site or also at the factory. The reaction solution is particularly well-suited for pre-oxidized or partially already patinated copper surfaces. Copper surfaces, which have not been completely green-patinated, or have been damaged, also obtain a uniform patina layer when the reaction solution is used. The reaction solution can be changed in its consistency and adapted to the conditions of use in each case by adding wetting agents or thickeners. The reaction solution can be applied using a brush, roller or spraying device, and can be stored and processed at ambient temperature.

15 Claims, No Drawings

PROCESS AND REACTION SOLUTION FOR PRODUCING A PATINA

BACKGROUND OF THE INVENTION

1. Field of the Invention

The present invention relates to a process and a reaction solution for producing a patina on surfaces of objects made of copper or a copper alloy.

2. Description of Related Art

When exposed to air, copper surfaces develop a thin green protective layer of basic copper compounds. This protective layer is called patina. It can sometimes take several decades for natural patina to form, depending on the environmental influences. To imitate this natural patina, which often only forms over long periods of time, one uses artificial patination, for example, by applying soluble copper salts or ammonium salts. In the case of imitated patina, basic copper compounds are applied as colored pigments having organic or inorganic film formers to a copper surface.

However, the known reaction solutions do not always have the desired effect as far as layer quality and coloration are concerned. It is also sometimes costly to handle and store these reaction solutions. Therefore, their suitability is limited for industrial production of a patina at the factory or for use at a construction site. Also, when some of these reaction solutions are used on pre-oxidized or partially already patinated copper surfaces, for example, to repair damaged patina, there is the risk of irregular layer formation or coloration.

SUMMARY OF THE INVENTION

It is an object of the present invention to devise a process for producing a mechanically stable patina on preferably pre-weathered copper surfaces, the produced patina exhibiting a reduced copper solubility, and being able to interact with the atmosphere, as is the case with natural patina. It is a further object of the present invention to achieve an improved reaction solution for producing a patina on copper surfaces, which will also be easier to handle and store.

These and other objects of the invention are achieved by a process for producing a patina on a surface of an object made of copper or a copper alloy, comprising the steps of cleaning the surface and thereafter applying to the surface a reaction solution containing an aqueous solution of copper salts and salts of inorganic acids. The surface is then allowed to dry while being protected from atmospheric influences. The invention also provides a reaction solution for producing a patina on a surface of an object made of copper or a copper alloy, the reaction solution comprising an aqueous solution of a copper salt and a salt of an inorganic acid.

DETAILED DESCRIPTION OF THE INVENTION

In accordance with the invention, a reaction solution containing an aqueous solution of copper salts and salts of inorganic acids is applied to the surface of a copper object after the surface is cleaned. The copper object, treated in this manner, is then allowed to dry, while being protected from the effects of the environment.

The drying is usually an air-drying, which is continued until the patina has fully hardened. The patina produced according to this process is mechanically stable and exhibits only a low copper solubility. The time required for producing the patina is comparatively short.

Preferably, the produced patina is provided with a transparent protective coat of varnish. For this purpose, a twocomponent water-base varnish containing rubber is preferably used. The varnish is colorless. Prior to the application, the varnish is prepared with a hardener. The ratio of hardener to varnish is usually 1:4. Preparation time is maximally 20 minutes. The ready-mixed varnish is then applied to the patina, preferably using a spraying device. After the drying phase, the varnish is fully cured and can be exposed to weathering. Depending on the prevailing environmental conditions (temperature, air humidity, etc.), the drying phase can take 15 to 24 hours.

The varnish coat applied in accordance with the present invention has the following properties and advantages, in particular:

- The varnish coat is transparent and mat. It does not change the optical properties of the underlying patina.
- The varnish coat can be treated with cleaning solutions. Accordingly, any stains, such as sprayed-on graffiti, can be removed by using special cleaning solutions without leaving any residues and without damaging the patina.
- The varnish coat allows water vapor to penetrate by diffusion. This permits the underlying patina to continue to interact with the atmosphere.
- The varnish coat has a strengthening effect on the underlying patina surface. As a result, the patinated copper objects can be mechanically worked [shaped], e.g., bent or folded, without causing the patina to flake off.

In another embodiment, the invention is a reaction solution containing an aqueous solution of copper salts and salts of inorganic acids. The reaction solution produces a patina on surfaces of objects made of copper or a copper alloy.

The reaction solution according to the present invention combines two different principles to produce patina. On the one hand, the reaction solution contains reactive components in the form of salts of inorganic acids, which react with the copper oxides of the patinated surfaces to form basic copper compounds. The rate of this reaction step depends on the weathering conditions. Furthermore, the solution already contains the copper compounds, which are produced in these reactions, in the form of copper salts as a kind of colored pigments. For this reason, a very good color perception is already achieved immediately upon application. The natural patina, which otherwise often forms only over long periods of time, is imitated in a short period of time. The subsequent chemical reaction intensifies the color perception and strengthens the entire patina layer.

Best results are achieved with the reaction solution according to the present invention when it is applied to a pre-oxidized or partially already patinated copper surface. For this reason, the surfaces of the copper objects should be pretreated accordingly. The copper surface can be pre-oxidized or pre-patinated at the factory. However, it is also possible for the copper surface to have a patina layer that has naturally formed by weathering. A copper surface, which has not been pretreated, should be exposed to natural weathering for approximately two months or longer.

Following a surface pretreatment of this kind, the treatment using the reaction solution according to the present invention can be carried out.

By applying the reaction solution to a pre-oxidized or partially already patinated copper surface, it is possible to produce the patina, either on the spot or at the factory. Copper surfaces, which are not completely green-patinated, or damaged patina layers, also obtain a uniform patina layer by applying the reaction solution according to the present invention. Depending on the composition of the reaction solution, one can vary the coloring of the patina to be produced, and otherwise adapt it to the particular surroundings.

The reaction solution according to the present invention is characterized by simple processing and handling. The application to the copper surfaces can be carried out using a brush, roller or spraying device.

The reaction solution can be stored at ambient temperature over a long period of several months without detrimental ageing effects.

Copper salts, which are well-suited for use in the aqueous reaction solution, are copper(I) carbonate, copper(II) carbonate, copper(I) chloride, copper(II) chloride, copper (II) sulphate, copper acetate, copper nitrate or mixtures thereof. Advantageous concentrations range from 5 to 500 g/l.

Preferably used reactive components are sodium carbonate, potassium carbonate, ammonium carbonate, sodium hydrogencarbonate, potassium hydrogencarbonate, sodium chloride, potassium chloride, ammonium chloride, sodium sulphate, sodium hydrogensulphate, potassium sulphate, potassium hydrogensulphate, or mixtures thereof. The concentrations of these salts of inorganic acids also range preferably from 5 to 500 g/l.

The reaction solution according to the present invention can be changed in its consistency and adapted to the conditions of use in each case by adding wetting agents or thickeners. In this context, wetting agents, such as surfactants and/or thickeners of known type are used. They are added to the reaction solution in a proportion of up to 5%.

The reaction solution according to the present invention produces a high-quality patina of basic copper compounds, and is particularly well-suited for pre-oxidized or partially already patinated copper surfaces. The treatment can be performed at the construction site or at the factory. In addition, the reaction solution is well-suited for repairing an existing patina or for adapting the color of a patina.

The reaction solution can be prepared and processed at ambient temperature. It is advisable that a patinated surface be protected from rain for at least 48 hours following treatment with the reaction solution.

It is particularly advantageous to subsequently coat the patina layer produced in this way with a transparent protective coat to prevent damage and to reduce the copper solubility. As mentioned earlier, varnishes allowing diffusion of water vapor are used for this, which produce an open-pored protective coat, thus enabling the patina surface to naturally interact with the atmosphere.

EXAMPLE

An exemplary embodiment of the reaction solution and of its production is described in the following:

An aqueous solution containing 200 g/l of copper sulphate is first mixed with 200 g/l of sodium carbonate and agitated for one hour at ambient temperature. 200 g/l of sodium chloride are then added and agitated again for one hour at ambient temperature. The solution can subsequently be directly applied to the surface to be patinated.

For a processing where a spray device is used, a wetting agent, such as a surfactant, is added in a concentration of 50 g/l.

To obtain a spreadable solution, the solution is thickened with a commercial thickener in a concentration of 50 g/l.

The reaction solution produced in this way can be stored at ambient temperature for an indefinite period of time.

The procedure for producing a patina on the surface of a copper object is described by way of example in the following:

Usually, the copper surface to be patinated exhibits a dark brown layer of copper oxide, which is already covered in places with copper salts (patina). The surface is freed from fat and loosely adhering dirt prior to patination. Loosely adhering particles of dirt can be removed using water and manual or mechanical aids.

Copper oxides remaining on the surface and already existing patina are not removed. The copper objects are preferably treated under dry weather conditions; it may be necessary to protect the surface to be patinated from precipitation by using suitable coverings.

After the cleaned surfaces have dried, those surface areas, which are not to be patinated, are masked. The ready-prepared reaction solution is then agitated or stirred, and applied. A spraying device has proved to be particularly suitable for this. Depending on the capacity of the particular spraying device, one uses nozzles having a diameter of between 0.2 and 0.6 mm. Spray angles of from 60° to 90° are considered advantageous to achieve a uniformly coated surface. Care must be taken during the treatment to prevent drops from forming on the surface.

If needed, a plurality of patination operations may be performed. One should ensure that the surface has completely dried prior to each additional patination operation.

After achieving the desired appearance of the copper surface, it is exposed to drying. Drying process should be as slow and uniform as possible. This improves the quality of the patina. Depending on the weather conditions, but preferably at the earliest after 48 hours, the protective coat of varnish can be applied. For this, a spraying device is recommended with nozzles having a diameter of between 0.2 mm and 0.3 mm, and a spray angle of 90°.

A single application of the protective coat is sufficient. During the time that the protective coat is dried, which, depending on the weather conditions, can take between 20 minutes and 24 hours, the copper object should be protected from precipitation.

Field tests conforming to DIN 50 017/KFW or DIN 50 917, Part 1, in which samples treated with the reaction solution according to the invention were weathered or exposed to natural weather for a period of six months, have shown that no changes worth mentioning can be ascertained on the patina. Therefore, the patina produced by the reaction solution has a very good weathering resistance.

What is claimed is:

1. A process for producing a patina on a surface of an object made of copper or a copper alloy, comprising the steps of a), cleaning the surface, b) applying to said surface a reaction solution comprising an aqueous solution of a copper salt and a basic salt selected from the group consisting of potassium carbonate, sodium hydrogen carbonate, potassium hydrogen carbonate, sodium sulphate, sodium hydrogen sulphate, potassium sulphate, potassium hydrogen sulphate or mixtures thereof, and c) allowing said surface to dry while being protected from atmospheric influences.

2. The process as recited in claim 1, further comprising the step of applying a transparent varnish coat to the patina.

3. The process as recited in claim 1, further comprising the step of applying a transparent varnish coat to the patina.

4. A reaction solution for producing a patina on a surface of an object made of copper or a copper alloy, the reaction solution comprising a), an aqueous solution of a copper salt, b), a basic salt selected from the group consisting of potassium carbonate, sodium hydrogen carbonate, potassium hydrogen carbonate, sodium sulphate, sodium hydrogen sulphate, potassium sulphate, potassium hydrogen sulphate or mixtures thereof, and c), at least one wetting agent in an amount not exceeding 5 g/l.

5. The reaction solution as recited in claim 4, wherein the copper salt is selected from the group consisting of copper(I) carbonate, copper(II) carbonate, copper(I) chloride, copper (II) chloride, copper(II) sulphate, copper acetate, copper nitrate and mixtures thereof.

6. The reaction solution as recited in claim 5, wherein the copper salt is present in a concentration of 5 to 500 g/l.

7. The reaction solution as recited in claim 4, wherein the salt of an inorganic acid is selected from the group consisting of sodium carbonate, potassium carbonate, ammonium carbonate, sodium hydrogencarbonate, potassium hydrogencarbonate, sodium chloride, potassium chloride, ammonium chloride, sodium sulphate, sodium hydrogensulphate, potassium sulphate, potassium hydrogensulphate, and mixtures thereof.

8. The reaction solution as recited in claim 5, wherein the salt of an inorganic acid is selected from the group consisting of sodium carbonate, potassium carbonate, ammonium carbonate, sodium hydrogencarbonate, potassium hydrogencarbonate, sodium chloride, potassium chloride, ammonium chloride, sodium sulphate, sodium hydrogensulphate, potassium sulphate, potassium hydrogensulphate, and mixtures thereof.

9. The reaction solution as recited in claim 6, wherein the salt of an inorganic acid is selected from the group consisting of sodium carbonate, potassium carbonate, ammonium carbonate, sodium hydrogencarbonate, potassium hydrogencarbonate, sodium chloride, potassium chloride, ammonium chloride, sodium sulphate, sodium hydrogensulphate, potassium sulphate, potassium hydrogensulphate, and mixtures thereof.

10. The reaction solution as recited in claim 7, wherein the salt of an inorganic acid is present in a concentration of 5 to 500 g/l.

11. The reaction solution as recited in claim 8, wherein the salt of an inorganic acid is present in a concentration of 5 to 500 g/l.

12. The reaction solution as recited in claim 9, wherein the salt of an inorganic acid is present in a concentration of 5 to 500 g/l.

13. The reaction solution as recited in claim 4, further comprising a thickener in a concentration of up to 5% on a weight per volume basis.

14. The reaction solution as recited in claim 6, further comprising a thickener in a concentration of up to 5% on a weight per volume basis.

15. The reaction solution as recited in claim 10, further comprising a thickener in a concentration of up to 5% on a weight per volume basis.

* * * * *